US010159118B2

(12) United States Patent
Herzog et al.

(10) Patent No.: US 10,159,118 B2
(45) Date of Patent: Dec. 18, 2018

(54) METHOD AND DEVICE FOR DETERMINING THE SUITABILITY OF A COOKWARE FOR A CORRESPONDING INDUCTION COIL OF AN INDUCTION COOKING HOB

(71) Applicant: Electrolux Appliances Aktiebolag, Stockholm (SE)

(72) Inventors: Michael Herzog, Rothenburg ob der Tauber (DE); Claus Meider, Rothenburg ob der Tauber (DE); Birgit Wiesend, Königstein (DE); Uwe Kallert, Rothenburg ob der Tauber (DE); Ulrich Häutle, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 189 days.

(21) Appl. No.: 14/907,716

(22) PCT Filed: Sep. 4, 2014

(86) PCT No.: PCT/EP2014/068804
§ 371 (c)(1),
(2) Date: Jan. 26, 2016

(87) PCT Pub. No.: WO2015/043906
PCT Pub. Date: Apr. 2, 2015

(65) Prior Publication Data

US 2016/0174297 A1 Jun. 16, 2016

(30) Foreign Application Priority Data

Sep. 30, 2013 (EP) ..... 13186620

(51) Int. Cl.
*H05B 6/12* (2006.01)
*H05B 6/08* (2006.01)
*H05B 6/06* (2006.01)

(52) U.S. Cl.
CPC ..... *H05B 6/062* (2013.01); *H05B 2213/05* (2013.01)

(58) Field of Classification Search
CPC ..... H05B 6/04; H05B 6/06; H05B 6/062; H05B 2213/05
(Continued)

(56) References Cited

U.S. PATENT DOCUMENTS 4,686,340 A * 8/1987 Fukasawa ..... H05B 6/06 219/626
2012/0285946 A1 11/2012 Brosnan

FOREIGN PATENT DOCUMENTS

EP 1793653 A2 6/2007
EP 2034801 A1 3/2009
(Continued)

OTHER PUBLICATIONS

International Search Report issued in PCT/EP2014/068804 dated Nov. 17, 2014, 3 pages.

*Primary Examiner* — Hung D Nguyen
(74) *Attorney, Agent, or Firm* — Pearne & Gordon LLP

(57) ABSTRACT

A method for determining the suitability of a cookware for a corresponding induction coil of an induction cooking hob is provided. The method includes detecting current through the induction coil, detecting the phase difference between the voltage and current of the induction coil, and detecting the frequency at the induction coil. The method further includes comparing the detected current with a stored maximum value of the current, comparing the detected phase difference with a stored maximum value of the phase difference, comparing the detected frequency with a stored
(Continued)

maximum frequency, calculating the power transfer from the detected current, phase difference and/or frequency, estimating the suitability of the cookware in dependence of the power transfer and at least one of the compared parameters, and outputting at least one optical and/or acoustic signal corresponding with the suitability of the cookware.

12 Claims, 1 Drawing Sheet

(58) Field of Classification Search
USPC ..... 219/620, 621, 622, 626, 660, 661, 664, 219/665, 625
See application file for complete search history.

(56) References Cited

FOREIGN PATENT DOCUMENTS

| | | | | |
|---|---|---|---|---|
| EP | 2360989 A1 * | 8/2011 | ..... | H05B 6/062 |
| EP | 2437573 A1 * | 4/2012 | ..... | H05B 6/062 |
| EP | 2440010 A1 | 4/2012 | | |

* cited by examiner

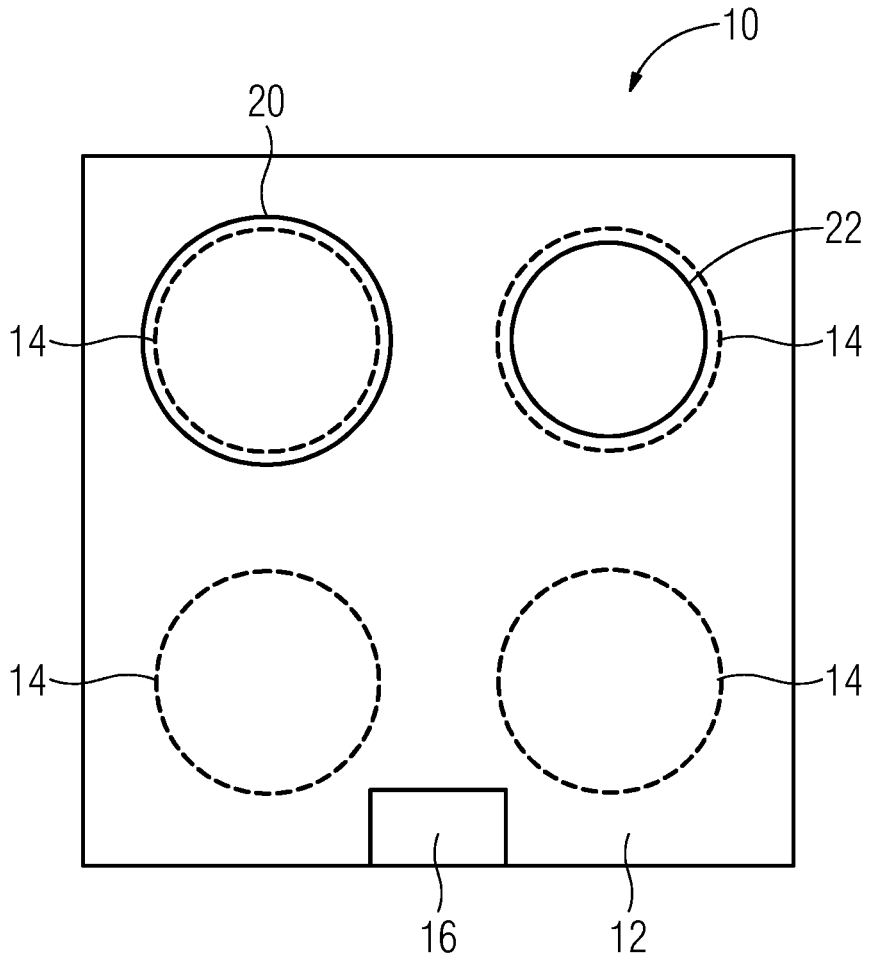
10
20
22
14
14
14
14
16
12

METHOD AND DEVICE FOR DETERMINING THE SUITABILITY OF A COOKWARE FOR A CORRESPONDING INDUCTION COIL OF AN INDUCTION COOKING HOB

The present invention relates to a method for determining the suitability of a cookware for a corresponding induction coil of an induction cooking hob. Further, the present invention relates to a device for determining the suitability of the cookware for the corresponding induction coil of the induction cooking hob. Moreover, the present invention relates to a corresponding control unit and induction cooking hob.

In an induction cooking hob a high frequency electromagnetic field generated by an induction coil penetrates the bottom of a cookware, so that heat is generated in the cookware. The power of said electromagnetic field is stronger, the more the cookware is suitable for the induction coil. A high efficient cookware absorbs the power without losses, if said cookware is concentrically arranged above the induction coil and the sizes of the cookware and the induction coil are substantially the same.

However, if actually the cookware is concentrically arranged above the corresponding induction coil and the sizes of the cookware and the induction coil are substantially the same, then there are further reasons that the expected power is not transferred from the induction coil to the cookware. For example, the percentage of the magnetic materials in the bottom of the cookware is relative small. Further, the magnetic properties of the cookware may be changed over the time. Moreover, the material of the cookware may be saturated.

If the material of the cookware is saturated, then the cookware can only absorb a limited power. The saturation of the magnetic material leads to non-linear effects. If the magnetic flux density is about 0.5 T to 1 T, then the magnetic conductivity of the saturated material decreases. In this case, magnetic properties depending on the magnetic flux density are no longer constant and harmonic components may occur.

The user can recognize, if the cookware is concentrically arranged above the corresponding induction coil and the sizes of the cookware and the induction coil are substantially the same either directly or by using auxiliary means. However, the user cannot recognize, if the percentage of the magnetic materials in the bottom of the cookware is relative small, if the magnetic properties of the cookware have been changed over the time, and if material of the cookware is saturated.

It is an object of the present invention to provide a method for determining the suitability of the cookware for the corresponding induction coil of the induction cooking hob, which method overcomes the problems mentioned above.

The object is achieved by the method according to claim 1.

The method for determining the suitability of a cookware for a corresponding induction coil of an induction cooking hob includes the steps of:

- detecting the current through the induction coil, and/or
- detecting the phase difference between the voltage and current of the induction coil, and/or
- detecting the frequency at the induction coil, and
- comparing the detected current with a stored maximum value of said current, and/or
- comparing the detected phase difference with a stored maximum value of said phase difference, and/or

- comparing the detected frequency with a stored maximum frequency, respectively, and
- calculating the power transfer from the detected current, phase difference and/or frequency,
- estimating the suitability of the cookware in dependence of the power transfer and at least one of the compared parameters, and
- outputting at least one optical and/or acoustic signal corresponding with the suitability of the cookware.

The main idea of the present invention is that different power and the reaction of the electromagnetic field effect different parameter values, which can be used for indicating the efficiency and quality of the electromagnetic power transfer. On the one hand the suitability of the cookware is estimated in dependence of the power transfer. On the other hand at least one of the compared parameters is also used for estimating the suitability of the cookware.

For example, the method is performed at a full power of the induction coil. Alternatively or additionally, the method is performed or repeated at a reduced power of the induction coil.

Preferably, the stored maximum values depend on the allowed losses of power semiconductor elements driving the induction coil.

In particular, the method is provided as a separate function and independent of any cooking process. The method is provided for checking, if the cookware is suitable for the induction coil. It is not necessary to integrate this method in each cooking process.

According to a preferred embodiment of the present invention, the method is activatable by the user after the cookware has been put above the induction coil.

The signal may include a number of discrete expressions corresponding with a degree of the suitability of the cookware. For example, the signal includes three expressions "suitable", "of limited suitability" and "not suitable" shown on a display.

Further, the current, the phase difference and/or the frequency may be detected in an electronic power circuit driving the induction coil. The detection within the electronic power circuit is realized by low complexity. Usually, the electronic power circuit includes already components appropriate for detecting the current, the phase difference and/or the frequency.

Moreover, the current, the phase difference and/or the frequency may be detected by inductive methods.

Preferably, the maximum values of the current, the phase difference and the frequency are stored in a memory of the cooking hob.

Further, the present invention relates to a device for determining the suitability of a cookware for a corresponding induction coil of an induction cooking hob, wherein the device is provided for the method mentioned above.

Moreover, the present invention relates to a control unit for an induction cooking hob, wherein the control unit comprises the device mentioned above.

Additionally, the present invention relates to an induction cooking hob including at least one induction coil, wherein the induction cooking hob includes the device and/or the control unit mentioned above.

Further, the present invention relates to a system for performing the method mentioned above, wherein the system is realized in hardware, software or a combination of hardware and software.

At last, the present invention relates to a computer program product stored on a computer usable medium, comprising computer readable program means for causing a computer to perform a method mentioned above.

Other features, embodiments and advantages of the present invention are set forth in the appended claims.

The present invention will be described in further detail with reference to the drawings, in which FIG. 1 illustrates a schematic top view of an induction cooking hob according to a preferred embodiment of the present invention.

FIG. 1 illustrates a schematic top view of an induction cooking hob 10 according to a preferred embodiment of the present invention.

The induction cooking hob 10 includes a cooking panel 12, a number of induction coils 14 and a user interface 16. The induction coils 14 are arranged below the cooking panel 12. In this example, the induction cooking hob 10 includes four induction coils 14. The cooking panel 12 comprises four cooking zones corresponding with one induction coil 14 in each case. In this example, the cooking zones and the corresponding induction coils 14 are circular. In general, the cooking zones and the induction coils 14 may have other geometrical shapes.

The user interface 16 comprises control elements. Said control elements are provided for activating and deactivating the induction coils 14. Further, the control elements are provided for adjusting the power of the induction coils 14. Additionally, the user interface 16 may comprise one or more display elements. Said display elements are provided for indicating activated and/or deactivated states of the induction coils 14 and the power of the induction coils 14.

A first cookware 20 is arranged upon one of the cooking zones. The first cookware 20 is arranged concentrically above the left rear induction coil 14. The concentric arrangement of the first cookware 20 above the induction coil 14 allows a maximum power of the electromagnetic field generated by said induction coil 14 and is the ideal position of the cookware 20. The base area of the first cookware 20 is bigger than the induction coil 14, so that the cookware 20 covers completely said induction coil 14. A second cookware 22 is arranged concentrically above the right rear induction coil 14. The base area of the second cookware 22 is smaller than the induction coil 14, so that the second cookware 22 does not completely cover the induction coil 14.

The suitability of the cookware 20 or 22 for the corresponding induction coil 14 can be ascertained by determining the power transfer from the induction coil 14 to the cookware 20 or 22 arranged above said induction coil 14 of the induction cooking hob 10. The determination of the suitability of the cookware 20 or 22 is a separate process, which is independent of the cooking process. It is not necessary to integrate this method in each cooking process. The method is activatable by the user after the cookware 20 or 22 has been put above the induction coil 14.

At least the current through the induction coil 14 is detected. Additionally, the phase difference between the voltage and current of the induction coil 14 and/or the frequency at the induction coil 14 may be detected. A maximum current, a maximum phase difference and/or a maximum frequency are stored in a memory.

The detected parameters are compared with the corresponding maximum values. If the at least one of the detected parameters exceeds the corresponding maximum value, then the cookware 20 is not suitable or only partially suitable. The power transfer is calculated from the detected current, phase difference and/or frequency. The suitability of the cookware 20 or 22 is estimated in dependence of the power transfer and at least one of the compared parameters. At last an optical and/or acoustic signal corresponding with the suitability of the cookware is output by the user interface 16. The signal may include a number of discrete expressions corresponding with a degree of the suitability of the cookware. For example, the signal includes three expressions like "suitable", "of limited suitability" and "not suitable" shown on a display.

On the one hand the suitability of the cookware 20 or 22 is estimated in dependence of the power transfer. On the other hand at least one of the compared parameters is also used for estimating the suitability of the cookware 20 or 22.

The present invention can also be embedded in a computer program product which comprises all the features enabling the implementation of the methods described herein. Further, when loaded in computer system, said computer program product is able to carry out these methods.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 induction cooking hob
12 cooking surface
14 induction coil
16 user interface
20 first cookware
22 second cookware

The invention claimed is:

1. A method for determining the suitability of a cookware for a corresponding induction coil of an induction cooking hob, wherein the method includes the steps of:

detecting current through the induction coil, detecting a frequency at the induction coil, comparing the detected current with a stored maximum value of said current, comparing the detected frequency with a stored maximum value thereof, calculating power transfer from the detected current and the detected frequency, estimating the suitability of the cookware in dependence of the calculated power transfer and the compared frequency, and outputting at least one optical and/or acoustic signal corresponding with the suitability of the cookware.

2. The method according to claim 1, wherein the method is performed at a full power of the induction coil.

3. The method according to claim 1, wherein the method is performed at a reduced power of the induction coil.

4. The method according to claim 1, wherein the stored maximum values depend on allowed losses of power semiconductor elements driving the induction coil.

5. The method according to claim 1,
wherein
the method is provided as a separate function and independent of any cooking process.

6. The method according to claim 1,
wherein
the method is activatable by a user after the cookware has been put above the induction coil.

7. The method according to claim 1,
wherein
the signal includes a number of discrete expressions corresponding with a degree of the suitability of the cookware.

8. The method according to claim 1,
wherein
the current and/or the frequency are detected in an electronic power circuit driving the induction coil.

9. The method according to claim 1,
wherein
the current and/or the frequency are detected by inductive methods.

10. The method according to claim 1,
wherein
the maximum values of the current and the frequency are stored in a memory of the cooking hob.

11. A device for determining the suitability of a cookware for a corresponding induction coil of an induction cooking hob,
the device comprising:
an electronic power circuit configured to detect current through the induction coil and a frequency at the induction coil; and
a control unit configured to:
compare the detected current with a stored maximum value of said current,
compare the detected frequency with a stored maximum value thereof,
calculate power transfer from the detected current and the detected frequency,
estimate the suitability of the cookware in dependence of the calculated power transfer and the compared frequency, and
output at least one optical and/or acoustic signal corresponding with the suitability of the cookware.

12. An induction cooking hob, comprising:
at least one induction coil; and
a device comprising:
an electronic power circuit configured to detect current through the at least one induction coil and a frequency at the at least one induction coil; and
a control unit configured to:
compare the detected current with a stored maximum value of said current,
compare the detected frequency with a stored maximum value thereof,
calculate power transfer from the detected current and the detected frequency,
estimate a suitability of a cookware for a corresponding induction coil of the induction cooking hob in dependence of the calculated power transfer and the compared frequency, and
output at least one optical and/or acoustic signal corresponding with the suitability of the cookware.

* * * * *